United States Patent [19]

Olson

[11] Patent Number: 4,702,089

[45] Date of Patent: Oct. 27, 1987

[54] DEVICE FOR RETURNING OIL TO AT LEAST ONE COMPRESSOR IN A COOLING OR REFRIGERATING SYSTEM

[76] Inventor: Hans E. E. Olson, Sigurdsgat. 28, S-214 65 Malmö , Sweden

[21] Appl. No.: 865,194

[22] PCT Filed: Sep. 16, 1985

[86] PCT No.: PCT/SE85/00350

§ 371 Date: May 15, 1986

§ 102(e) Date: May 15, 1986

[87] PCT Pub. No.: WO86/01882

PCT Pub. Date: Mar. 27, 1986

[30] Foreign Application Priority Data

Sep. 17, 1984 [SE] Sweden ..... 8404641

[51] Int. Cl.[4] ..... F25B 41/00

[52] U.S. Cl. ..... 62/471; 62/503; 184/58

[58] Field of Search ..... 184/58; 62/471, 503

[56] References Cited

U.S. PATENT DOCUMENTS

| | | | |
|---|---|---|---|
| 2,003,543 | 6/1935 | Jordan | 62/471 X |
| 2,364,783 | 12/1944 | Goddard et al. | 62/471 |
| 3,177,680 | 4/1965 | Rasovich et al. | 62/503 X |
| 3,563,053 | 2/1971 | Bottum | 62/471 X |
| 3,581,519 | 6/1971 | Garrett | 62/468 |
| 3,792,594 | 2/1974 | Kramer | 62/503 |
| 4,551,990 | 11/1985 | Honoshowsky | 62/503 X |

FOREIGN PATENT DOCUMENTS

| | | | |
|---|---|---|---|
| 724821 | 5/1932 | France | 62/471 |
| 699568 | 11/1953 | United Kingdom | 62/503 |

*Primary Examiner*—Leonard E. Smith

*Attorney, Agent, or Firm*—Bacon & Thomas

[57] ABSTRACT

This invention relates to a device for returning oil to at least one compressor (1) in a cooling or refrigerating system, in which the compressor sucks oil (16) from an oil collecting container (13) through at least one suction conduit (14) connected to the collecting container (13) and having one or more gas and oil intakes (15) which is or are situated above the oil level (16*a*) in the collecting container (13). To permit returning oil together with refrigerant and ensure a continuous oil supply to the compressor when in operation irrespectively of whether there are small or large oil amounts in the collecting container, the suction conduit (14) connects the gas and oil intake (15) to the inside (17) of the collecting container (13) above the oil level (16*a*) therein, and the gas and oil intake (15) has a substantially smaller throughflow area than the collecting container (13) to produce such a gas velocity in the gas and oil intake (15) that after the oil (16) collected in the collecting container (13) has been foamed up at the start of the compressors, the gas is capable of elevating the collected oil (16) on the inside of the collecting container (13) to the suction conduit gas and oil intake (15) and carrying it farther into the suction conduit (14) as the intake or intakes are connected to the inside (17) of the collecting container (13).

8 Claims, 2 Drawing Figures

DEVICE FOR RETURNING OIL TO AT LEAST ONE COMPRESSOR IN A COOLING OR REFRIGERATING SYSTEM

This invention relates to a device for returning oil to at least one compressor in a cooling or refrigerating system in which the compressor sucks oil from at least one oil collecting container through at least one suction conduit connected to the collecting container and having one or more gas or oil intakes situated above the oil level in the collecting container.

Devices of the type outlined above suffer from the drawback that large amounts of oil may collect in the collecting container so that the compressor crankcase may be emptied of oil. Owing to such lack of oil therein the compressor may seize. To remedy this drawback attempts have been made to provide a continuous return of oil from the collecting container to the compressor with the aid of various kinds of devices. However, with such prior-art devices the oil risks to be drawn into the compressor portion-wise, which is unsuitable as the compressor may thereby be damaged. Moreover, large amounts of refrigerant risk to be drawn into the compressor, which may also result in damage to the compressor.

GB patent specification No. 699,568 describes and shows an oil returning device which does not, however, permit returning the oil together with the refrigerant. For a rational function of the prior-art oil returning device a definite oil level must be maintained in the collecting pipe, which is difficult to realize in practice.

U.S. Pat. Nos. 3,581,519 and 3,792,594 describe and show oil returning devices which do not either permit returning the oil together with the refrigerant. In these previously known devices, oil return conduits extend from the bottom portions of the collecting containers in order to return separated oil. No return of oil together with refrigerant takes place in these devices either.

The object of the present invention is to provide a device which permits returning oil together with refrigerant and which ensures a continuous oil supply to the compressor when in operation irrespectively of whether there are small or large amounts of oil in the collecting pipe. This is achieved according to the invention substantially with the use of the characteristic features defined in the appendant claim 1.

Applying the features indicated in claim 1, it is realized that, after the foaming of the oil at the start of the compressor has produced an oil coating on the inside of the collecting pipe up to the gas and oil intake, the oil can be caused to creep continuously upward on the walls of the collecting container and continuously sucked into the suction pipe and via the latter continuously into the compressor.

Figure 1:
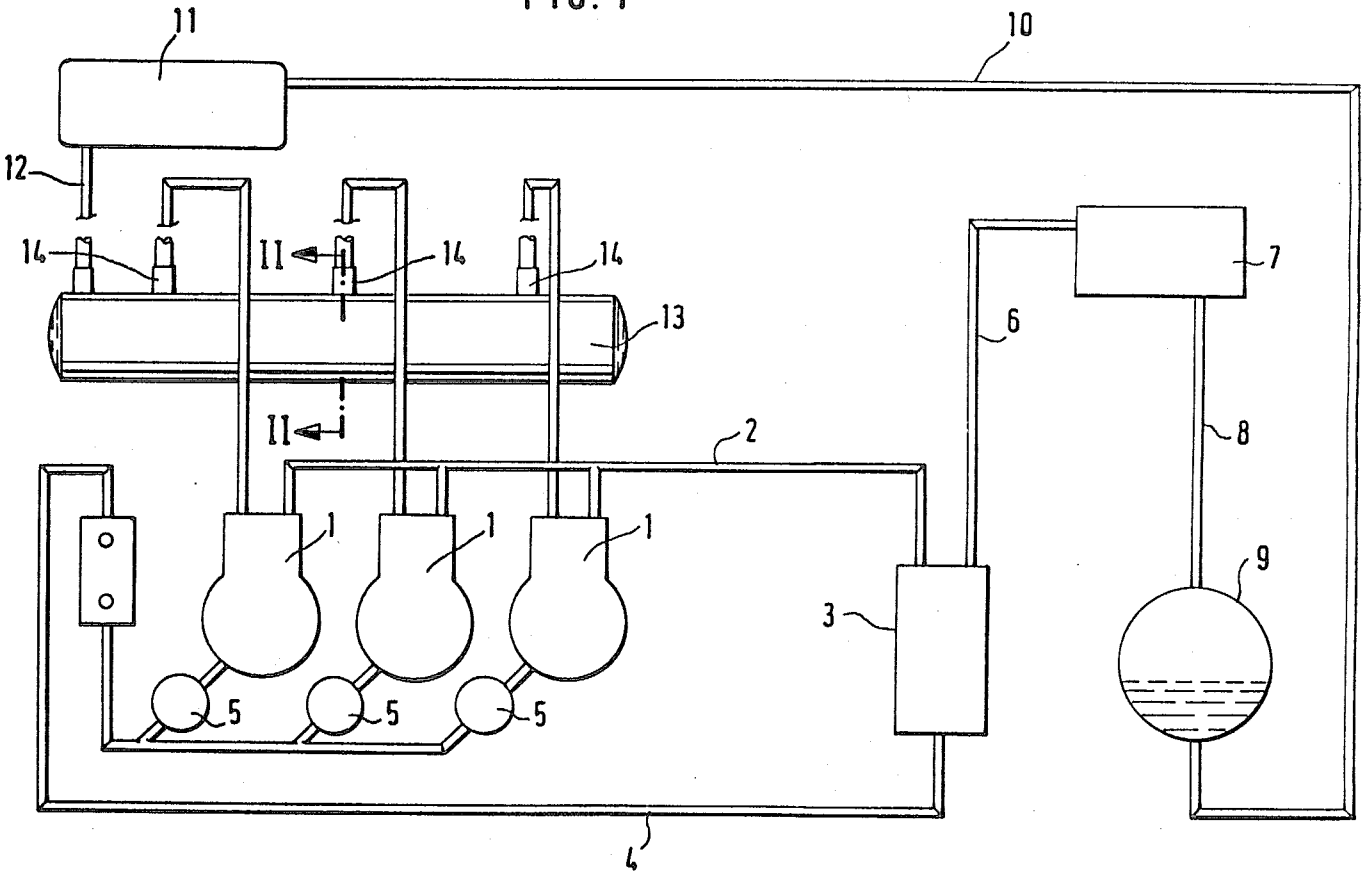
Figure 2:
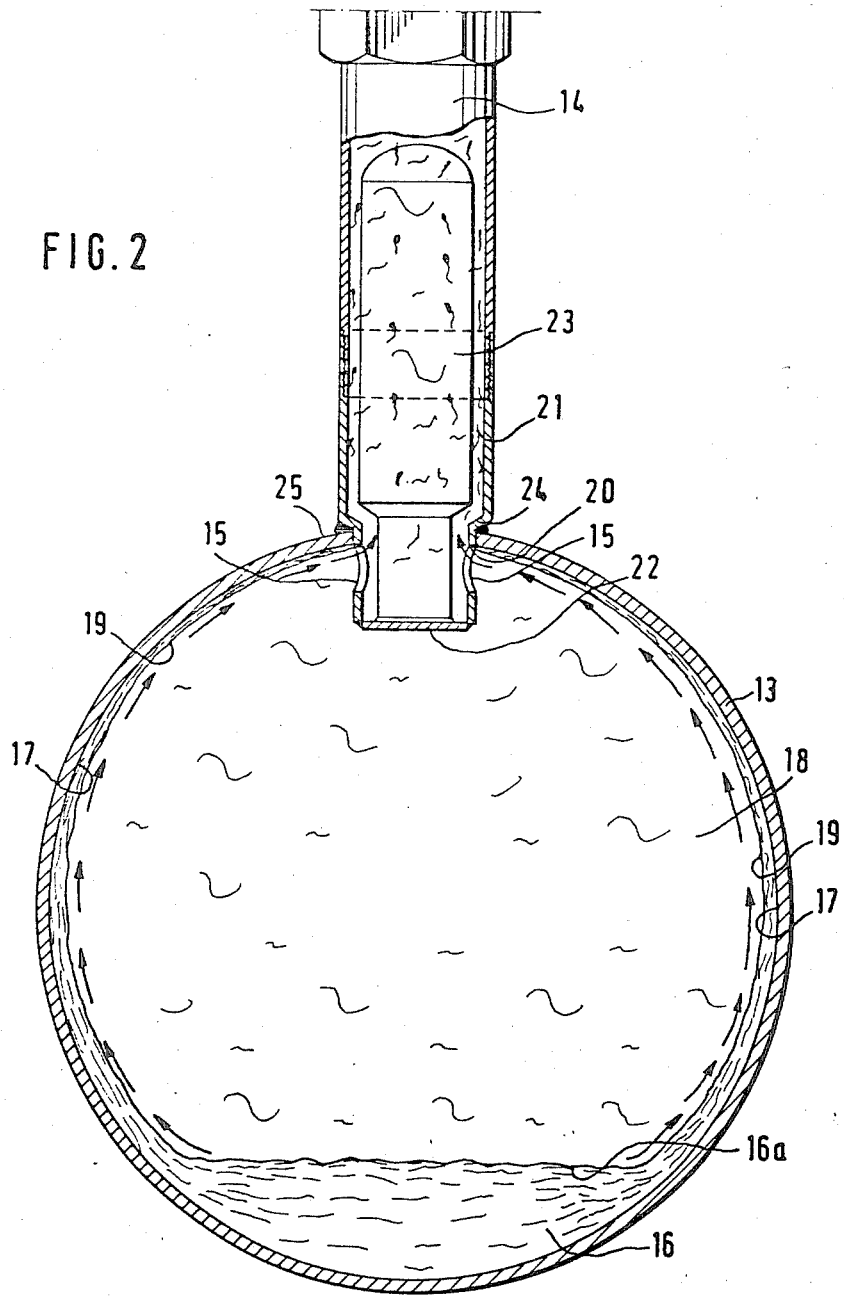

The invention is elucidated more in detail below with reference to the accompanying drawings in which:

FIG. 1 diagrammatically illustrates a freezing plant comprising a device according to the invention; and FIG. 2 is a section on line II—II in FIG. 1, that is through a collecting container and a suction pipe of the freezing plant.

The freezing plant illustrated comprises three compressors 1 which are adapted to pump out hot gas through a hot gas conduit 2. At the discharge of the hot gas, large amounts of oil accompany the gas out of the compressors 1 and the major portion of this oil is separated from the hot gas in an oil separator 3 from which the oil is refluxed to the compressors 1 via a reflux pipe 4 which is provided with one oil level control 5 for each compressor 1. As no complete oil separation can be attained in the oil separator 3 some oil will accompany the hot gas through the conduit 6 to a condensor 7 and via the condensate therefrom through a conduit 8 to a refrigerant container 9. The oil then accompanies the refrigerant from the refrigerant container 9 through a conduit 10 to an evaporator 11 and the refrigerant vapour from said evaporator to a collecting container 13. The intention then is for the oil 16 collected in the collecting container 13 to be supplied to the compressors 1 continuously and as uniformly distributed as possible between said compressors through suction conduits 14 which are adapted to supply gas in the form of refrigerant vapour from the collecting container 13 to the compressors 1.

To realize such a continuous oil supply to the compressors 1 and to ensure that the oil is distributed as uniformly as possible between them, each suction conduit 14 is provided with at least one gas and oil intake 15 which is located above the oil level 16*a* of the collecting container 13, connects onto the inside 17 of the collecting container 13 and has a substantially smaller throughflow area than the collecting container 13 to bring about such a gas velocity in the gas and oil intake 15 that the gas in capable of carrying along the collected oil 16 in an upward direction on the inside 17 of the collecting container 13 to the gas and oil intake 15 after the inside 17 has been coated with an oil film generated by the foaming of the oil at the start of the compressors. Thus, at the start of the compressors the oil 16 contained at the bottom of the collecting container 13 will foam up, said foaming being so vigorous that the inside 17 of the collecting container 13 is coated with an oil film 19 all the way up to the gas and oil intake 15. By reason of the high gas velocity in the gas and oil intake 15 the gas will successively suck the oil film 19 into the gas and oil intake 15 and the film-like oil flow 19 will successively be replenished from below with oil 16 from the lower portions of the collecting container 13. As long as said high gas velocity is maintained the oil will "creep" from the lower portions of the collecting container 13 on the inside 17 to the gas and oil intake 15 in a continuous oil flow 19. The gas and oil intake 15 is so arranged that the oil flow 19 is not interrupted when it passes from the inside 17 into the suction conduit 14. Such an uninterrupted flow can be brought about because the upper edge 20 of the gas and oil intake 15 lies in the prolongation of the inside 17, i.e. the upper edge 20 connects exactly onto the inside 17 to form a prolonged part thereof. It is not, however, absolutely necessary for the upper edge 20 to be placed absolutely exactly in the prolongation of the inside 17 but said upper edge 20 can be placed at a slightly higher level without causing any decisive negative interruption of the flow. The oil flow can also be kept fairly undisturbed if the upper edge 20 for some reason should end up slightly below the prolongation of the inside 17. Certainly there will thus be formed a threshold but provided this threshold is not too high and the gas velocity is sufficient, the gas will nevertheless be able to "suck" the oil into the suction conduit 14. Such a "threshold" should, however, be avoided as a rule because it will interrupt the oil flow 19 if it extends too far downward below the prolongation of the inside 17 and/or if the gas velocity is insufficient.

To ensure an effective oil transport in the suction conduit 14 inside the gas and oil intake 15 the parts 21 of the suction conduit 14 which are situated inside the gas and oil intake 15 present substantially the same throughflow area as the gas and oil intake 15. As a result, the velocity of the gas flowing into the suction conduit 14 is maintained, which in turn implies an effective oil transport also inside the gas and oil intake 15.

To provide substantially the same throughflow area of the gas and oil intake 15 as that of the parts 21 of the suction conduit 14 situated inside the intake 15, the said parts 21 of the suction conduit 14 may be provided with a filling 23.

A structurally simple embodiment is obtained by providing the suction conduit 14 with an end portion 22 which is lowered radially into the collecting container 13 and which in its side wall has two gas and oil intakes 15 opposite one another, as shown in FIG. 2. In some cases it may, however, be possible or advantageous to arrange another number of gas and oil intakes in the suction conduit 14.

The suction conduit 14 may preferably be vertically directed and inserted in the upper part of the collecting container 13 such that the gas and oil intakes 15 will connect onto the uppermost portions of the inside 17. As shown in FIG. 2, the collecting container 13 may be a pipe of circular cross section and the suction conduit 14 may be radially directed in relation to said pipe. The pipe preferably extends horizontally and the suction conduit 14 need not necessarily be vertically directed but may possibly extend at an inclination of approximately 45° in relation to the pipe such that the distance between the oil level 16*a* and the end portion 22 of the suction pipe 14 is shortened.

To ensure at the mounting of the suction conduit 14 to the collecting container 13 that the gas and oil intake 15 will take the desired position in relation to the inside 17 of the collecting container 13, the suction conduit 14 has a shoulder 24 which is spaced from the gas and oil intake 15 a distance corresponding to the wall thickness of the collecting container 13. The shoulder 24 is preferably formed by a transitional portion at which the suction conduit 14 outside the collecting container 13 merges into an end portion 22 of smaller diameter. Said shoulder 24 permits disposing the gas and oil intake 15 of the suction conduit 14 in exactly correct relation to the inside 17 of the collecting container 13 simply by inserting the suction couduit 14 in a hole made for that purpose in the collecting container 13 until the shoulder 24 abuts against the outer side 25 of the collecting container 13.

The invention is not restricted to the embodiment described and illustrated but can be varied within the scope of the appended claims. Thus, the device can also be utilised in refrigerating systems, and the constituent parts may vary in shape, disposition and number and still function in the manner contemplated. The device is usable for one and preferably for several compressors. In the latter case, it can be utilised to advantage for a uniform oil distribution between the compressors.

I claim:

1. A device for returning oil to at least one compressor in a cooling or refrigerating system, in which the compressor sucks oil from at least one oil collecting container through at least one suction conduit connected to the collecting container and having one or more gas and oil intakes situated above the oil level in the collecting container, wherein the gas and oil intake connects onto the inside of the collecting container above the oil level and the gas and oil intake has a substantially smaller throughflow area than the collecting container to produce such a gas velocity in the gas and oil intake that after the oil collected in the collecting container has been foamed up at the start of the compressors, the gas is capable of elevating the collected oil on the inside of the collecting container to the suction conduit gas and oil intake above the oil level and carrying it farther into the suction conduit as said intake or intakes are connected to the inside of the collecting container and wherein the gas and oil intake is disposed in the side wall of an end portion of the suction conduit, which end portion extends radially down into the collecting container, and upper edge of the gas and oil intake connecting onto the inside of the collecting container.

2. A device as claimed in claim 1, wherein the end portion of the suction conduit comprises two gas and oil intakes which are arranged in opposite side walls of the end portion.

3. A device as claimed in claim 1, wherein inside the gas and oil intake the suction conduit has substantially the same throughflow area as the gas and oil intake to maintain the velocity of the gas flowing into the suction conduit.

4. A device as claimed in claim 3, wherein inside the gas and oil intake the suction conduit comprises a filling which fills out parts of the suction conduit to provide substantially the same throughflow area of said suction conduit parts as that of the gas and oil intake.

5. A device as claimed in claim 1, wherein the suction conduit has a shoulder which is spaced from the gas and oil intake a distance corresponding to the wall thickness of the collecting container.

6. A device as claimed in claim 5, wherein the shoulder is formed by a transitional portion at which the parts of the suction conduit outside the collecting container merge into an end portion of smaller diameter.

7. A device as claimed in claim 1, wherein the suction conduit is substantially vertically directed down into the collecting container.

8. A device as claimed in claim 7, in which the collecting container is in the form of a horizontally extending pipe of circular cross section, wherein the suction conduit is radially directed down into the pipe.

* * * * *